US005881877A

United States Patent [19]

Adams

[11] Patent Number: 5,881,877

[45] Date of Patent: Mar. 16, 1999

[54] CONTAINER FOR SAFETY EQUIPMENT

[76] Inventor: Darrell D. Adams, Rte. 3, Box 4070, Checotah, Okla. 74426

[21] Appl. No.: 904,792

[22] Filed: Aug. 1, 1997

[51] Int. Cl.[6] ..... B65D 85/18

[52] U.S. Cl. ..... 206/373; 206/38; 206/499; 220/555; 224/572; 224/901.4

[58] Field of Search ..... 206/372, 373, 206/581, 5, 6, 38, 499, 561, 823; 220/334, 555; 244/328, 463, 572, 901.2, 901.4

[56] References Cited

U.S. PATENT DOCUMENTS

| | | | |
|---|---|---|---|
| 4,865,186 | 9/1989 | Gates . | |
| 4,927,025 | 5/1990 | Thompson et al. | 206/38 |
| 4,951,811 | 8/1990 | Lines . | |
| 4,979,612 | 12/1990 | Melbye | 206/362 |
| 5,016,749 | 5/1991 | Kaye et al. . | |
| 5,056,661 | 10/1991 | Balzano | 224/901.4 |
| 5,178,295 | 1/1993 | Crumrine et al. | 220/555 |
| 5,193,226 | 3/1993 | Mortenson | 2/422 |
| 5,249,675 | 10/1993 | Strauss et al. . | |
| 5,253,756 | 10/1993 | Goekler | 206/561 |
| 5,344,002 | 9/1994 | Baczkowski . | |
| 5,501,382 | 3/1996 | Webb | 206/372 |
| 5,615,767 | 4/1997 | Eull et al. | 206/499 |

FOREIGN PATENT DOCUMENTS

| | | |
|---|---|---|
| 929172 | 12/1947 | France . |
| 94/24004 | 10/1994 | WIPO . |

*Primary Examiner*—Paul T. Sewell
*Assistant Examiner*—Luan K. Bui
*Attorney, Agent, or Firm*—Jack Lo

[57] ABSTRACT

A container for safety equipment includes a plurality of divided compartments and a hinged top cover. One compartment is arranged for snugly holding a pair of safety goggles. Another compartment is arranged for snugly holding a stack of breathing masks. A third compartment is arranged for holding a supply of ear plugs. The back of the container includes a set of screw holes, a hook-and-loop fastener, and a set of strap anchors. The container can be screwed to a fixed location by using the screw holes, or it can be releasably mounted to any desired location with the hook-and-loop fastener. The container can also be fixedly mounted on a tool, such as the handle of a lawn mower, with straps passed around the strap anchors.

3 Claims, 3 Drawing Sheets

CONTAINER FOR SAFETY EQUIPMENT

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates generally to containers, specifically to a container for holding safety equipment.

2. Prior Art

Safety equipment, such as goggles, breathing masks, and ear plugs, are necessary for a variety of activities that involve power tools, including wood working, metal machining, lawn mowing, etc. Because different safety equipment are provided in separate packages or containers, they are often stored in different locations and easily misplaced, so that they are difficult to find. Even if the power tools and the safety equipment are stored in the same location, the tools are often used far away from such location. People would often forget to bring the safety equipment along with the tool, and do not bother to go back for it. As a result, many people endanger their eyesight, respiratory system, and hearing because they can't find the safety equipment, or because the safety equipment simply isn't conveniently available when needed.

OBJECTS OF THE INVENTION

Accordingly an object of the present invention is to provide a container for safety equipment that stores together a pair of goggles, a supply of breathing masks, and a supply of ear plugs.

Another object of the present invention is to provide a container for safety equipment that can be fixedly attached at a desired location, so that the safety equipment is always in a known location.

Another object of the present invention is to provide a container for safety equipment that can also be removably attached to any location, so that it may be moved to another location when desired.

Another object of the present invention is to provide a container for safety equipment that can also be fixedly attached to a power tool, so that the safety equipment is conveniently available whenever and wherever the tool is used.

Yet another object of the present invention is to provide a container for safety equipment that can holds the safety equipment securely therein to prevent damaging them when the box is moved.

Further objects of the present invention will become apparent from a consideration of the drawings and ensuing description.

BRIEF SUMMARY OF THE INVENTION

A container for safety equipment includes three divided compartments and a hinged top cover. One compartment is sized and shaped for snugly holding a pair of eye goggles. Another compartment is sized and shaped for snugly holding a stack of breathing masks. A third compartment is sized for holding a supply of ear plugs. The back of the container includes a set of screw holes, a hook-and-loop fastener, and a set of strap anchors. The container can be screwed to a fixed location by using the screw holes, or it can be releasably mounted to any desired location with the hook-and-loop fastener. The container can also be fixedly mounted on a tool, such as the handle of a lawn mower, with straps passed around the strap anchors.

Figure 1:
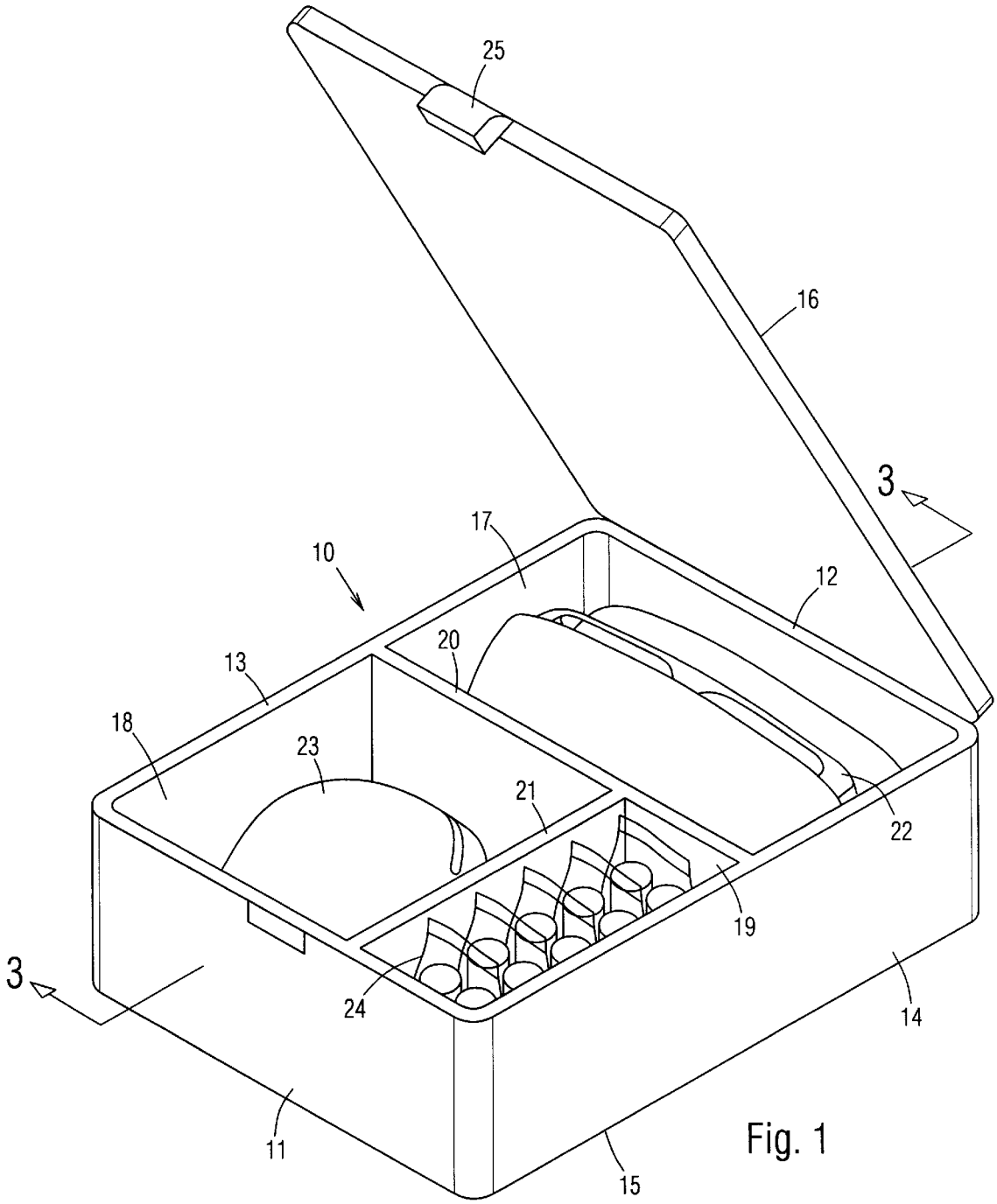
FIG. 1 is a top perspective view of a container for safety equipment in accordance with the invention.

| DRAWING REFERENCE NUMERALS | |
|---|---|
| 10. Container | 11. Front End Wall |
| 12. Rear End Wall | 13. Side Wall |
| 14. Side Wall | 15. Bottom Sheet |
| 16. Top Cover | 17. Goggle Compartment |
| 18. Breathing Mask Compartment | 19. Ear Plug Compartment |
| 20. Transverse Dividing Wall | 21. Longitudinal Dividing Wall |
| 22. Goggles | 23. Breathing Masks |
| 24. Ear Plugs | 25. Clasp |
| 26. Screw Holes | 27. Hook-and-Loop Fastener |
| 28. Strap Anchors | 29. Cavity |
| 30. Bar | 31. Mask-Shaped Bottom Portion |
| 32. Goggle Case | 33. Convex Inner Portion |
| 34. Convex Outer Portion | 35. Goggle Receiving Space |
| 36. Exit Opening | |

DETAILED DESCRIPTION OF THE INVENTION

FIG. 1

In accordance with a preferred embodiment of the invention shown in the top perspective view of FIG. 1, a container 10 includes a front end wall 11, a rear end wall 12, opposite side walls 13 and 14, a bottom closure 15, and a hinged top cover 16, which is shown in an opened position. A goggles compartment 17, a breathing mask compartment 18, and an ear plug compartment 19 are defined by a transverse dividing wall 20 extending between side walls 13 and 14, and a longitudinal dividing wall 21 extending between transverse dividing wall 20 and front end wall 11. A pair of eye goggles 22 is received in goggles compartment 17, a stack of five breathing masks 23 is received in mask compartment 18, and five pairs of packaged ear plugs 24 are received in ear plug compartment 19. A clasp 25 attached to the distal edge of hinged top cover 16 is usable for securing top 16 in a closed position.

FIG. 2

Figure 2:
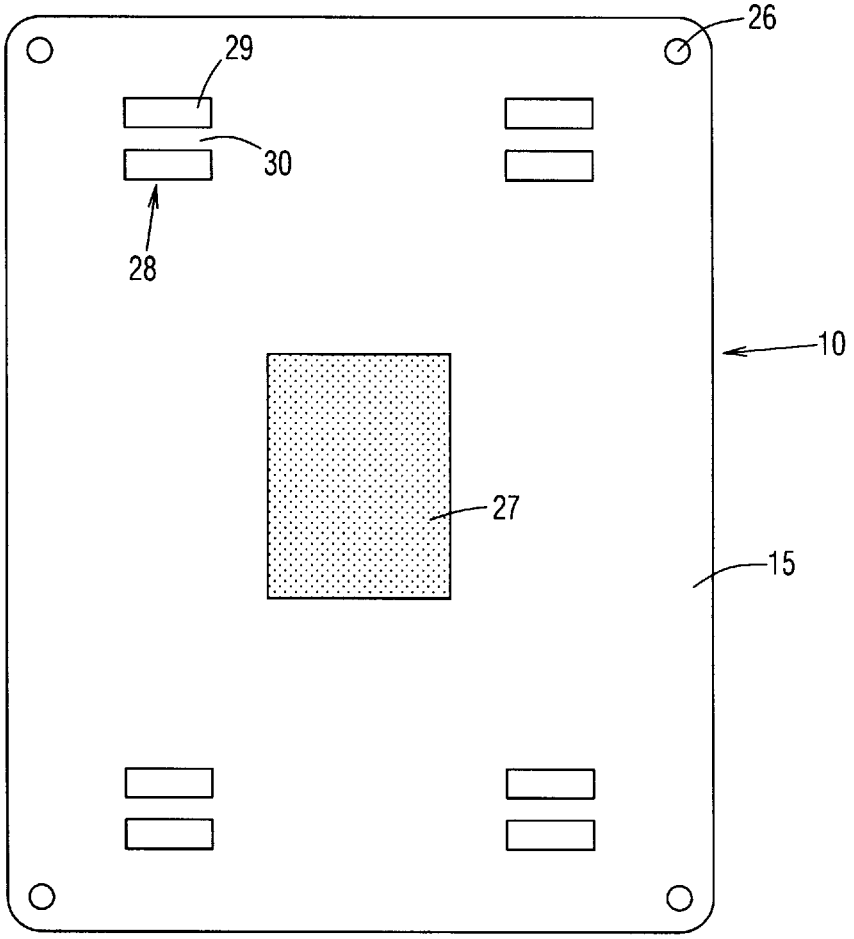
FIG. 2 is a bottom view of the container.

The container for safety equipment is shown in a bottom view in FIG. 2. The box provides three alternative means of attachment: screw, hook-and-loop fastener, and strap. Four screw holes 26 are arranged at the corners of bottom closure 15 for enabling permanent mounting to a fixed location, such as a wall, with screws (not shown). A hook-and-loop fastener 27 is arranged at the center of bottom 15 for removably attaching the box to any desired location where a complementary hook-and-loop fastener (not shown) is arranged. Four strap anchors 28 are also arranged near the corners of bottom closure 15. Strap anchors 28 each include a cavity 29 recessed into bottom closure 15, and a bar 30 extending across the opening of cavity 29, so that a conventional hose clamp (not shown) or other strapping device may be looped behind bar 30 for strapping the box onto a part of a power tool, such as the tubular handle of a push-type lawn mower (not shown).

FIG. 3

Figure 3:
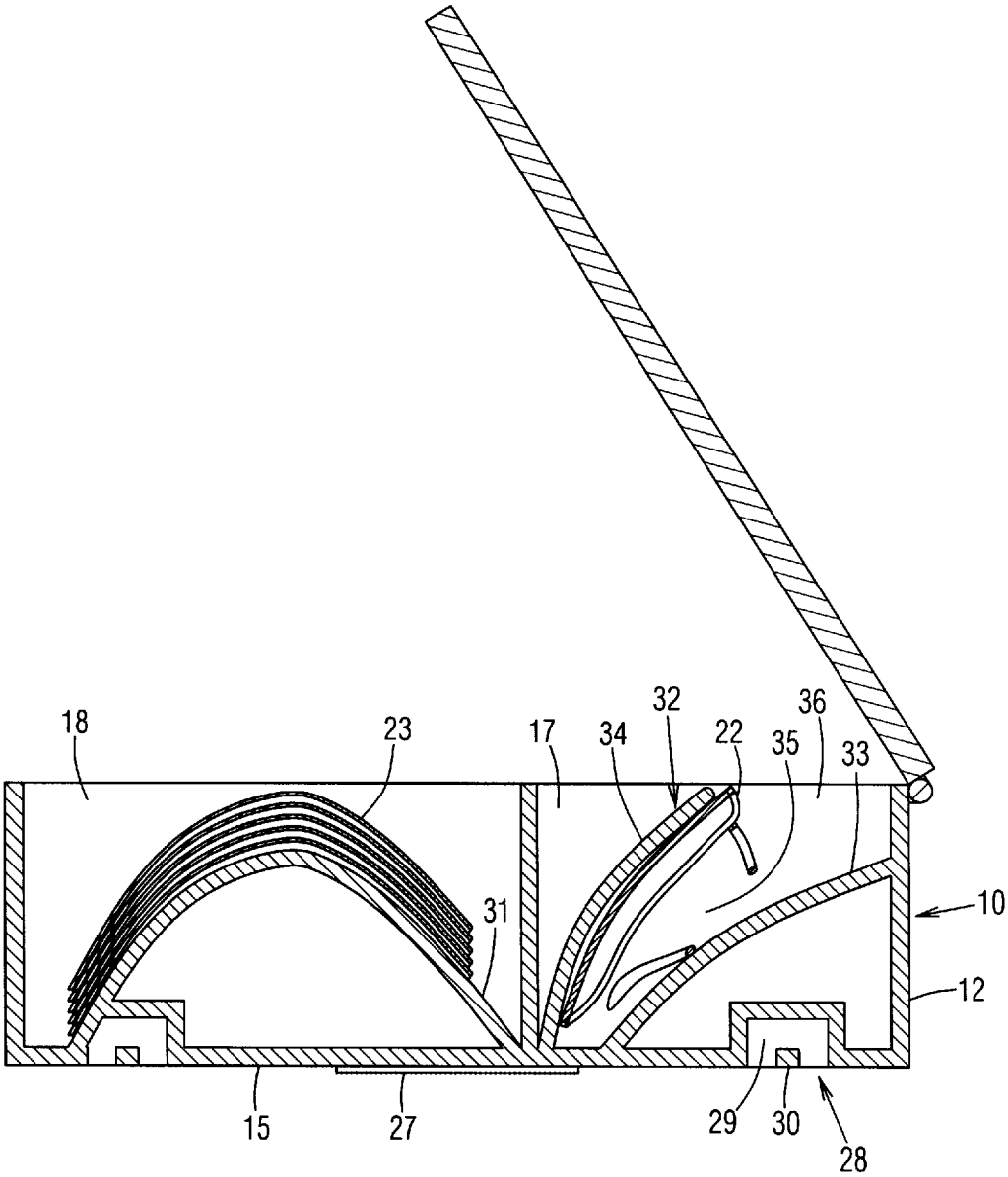
FIG. 3 is a side sectional view of the container, taken along line 3—3 in FIG. 1.

The container for safety equipment is shown in a sectional view in FIG. 3. Mask compartment 18 includes a generally mask-shaped, convex protruding bottom portion 31 for supporting a stack of five conventional, disposable breathing masks 23 on top thereof. Bottom portion 31 is sized and shaped to follow the interior contour of masks 23 and prevent them from shifting position. An integral goggles case 32 is provided in goggles compartment 17. Goggles case 32 includes a slanted, convex inner portion 33 extending between rear wall 12 and bottom closure 15 of container 10, and a convex outer portion 34 spaced from the top of convex inner portion 33. Convex outer portion 34 extends outward and rearward from a bottom of goggles compartment 17 to about midway across the outer opening thereof, so as to form a goggles receiving space 35 for receiving goggles 22, and an exit opening 36 through which goggles 22 may be removed. Goggles receiving space 35 generally conforms to the contour of goggles 22, so as to hold goggles 22 securely therein. Goggles receiving space 35 is angled outwardly for facilitating the removal of goggles 22.

SUMMARY AND SCOPE

Accordingly, I have provided a container for holding the most often used safety equipment, which includes a pair of goggles for eye protection, a supply of breathing masks for respiratory system protection, and a supply of ear plugs for hearing protection. It holds the safety equipment securely therein to prevent damaging when the box is moved. It can be fixedly attached to any location, so that the safety equipment is always in a known location, or it can be removably attached, so that it may be moved to a new location if desired. It can also be fixedly attached to a power tool, so that the safety equipment is conveniently available whenever and wherever the tool is used.

Although the above descriptions are specific, they should not be considered as limitations on the scope of the invention, but only as examples of the embodiments. Many substitutes and variations are possible within the teachings of the invention. For example, more or fewer masks or ear plugs can be provided. Longitudinal dividing wall 21 can extend between transverse dividing wall 20 and rear end wall 12. Therefore, the scope of the invention should be determined by the appended claims and their legal equivalents, not by the examples given.

I claim:

1. A container containing safety equipment, comprising:

a front end wall;

a rear end wall spaced from said front end wall;

opposite side walls extending between said front end wall and said rear end wall;

a bottom sheet extending between said front end wall and said rear end wall, and between said opposite side walls;

a hinged top having a proximal edge hingeably connected to said rear end wall;

a transverse dividing wall positioned between said front end wall and said rear end wall, said transverse dividing wall extending between said opposite side walls;

a longitudinal dividing wall extending between said transverse dividing wall and one of said end walls;

said transverse dividing wall, said one of said end walls, and said opposite side walls defining a safety goggles compartment;

a goggles case arranged integrally in said safety goggles compartment, said goggles case comprising a slanted inner portion angled outwardly from a lower edge to an upper edge thereof, and a slanted outer portion spaced from said slanted inner portion defining a goggles receiving space therebetween for receiving a pair of safety goggles;

said transverse dividing wall, said longitudinal dividing wall, one of said opposite side walls, and another one of said end walls defining a breathing mask compartment for receiving a breathing mask;

a mask-shaped, convex protruding bottom arranged in said breathing mask compartment for supporting said breathing mask; and said transverse dividing wall, said longitudinal dividing wall, another one of said opposite side walls, and said another one of said end walls defining an ear plug compartment for receiving a pair of ear plugs.

2. The container of claim 1, further including a plurality of strap anchors arranged on a lower surface of said bottom sheet for being fastened to a structure by a strap, each of said strap anchors includes a cavity recessed into said bottom sheet, and a bar extending across an opening of said cavity.

3. The container of claim 1, further including a hook-and-loop fastener arranged on a lower surface of said bottom sheet.

* * * * *